United States Patent [19]

Fehr et al.

[11] 4,427,858

[45] Jan. 24, 1984

[54] GROUNDING SWITCH

[75] Inventors: Werner Fehr, Effretikon; Claes Ohlin, Wetzikon; Bruno Schabrun, Wurenlos, all of Switzerland

[73] Assignee: BBC Brown, Boveri & Company, Limited, Baden, Switzerland

[21] Appl. No.: 317,859

[22] Filed: Nov. 3, 1981

[30] Foreign Application Priority Data

Nov. 5, 1980 [CH] Switzerland ..... 8215/80

[51] Int. Cl.[3] ..... H01H 33/12

[52] U.S. Cl. ..... 200/146 R; 200/118 R; 200/304; 200/245

[58] Field of Search ..... 200/148 A, 146 R, 304, 200/305, 245, 250, 287, 290

[56] References Cited

U.S. PATENT DOCUMENTS 2,429,311 10/1947 Gay ..... 200/148 A 3,786,215 1/1974 Mauthe ..... 200/148 A

*Primary Examiner*—Robert S. Macon

*Attorney, Agent, or Firm*—Burns, Doane, Swecker & Mathis

[57] ABSTRACT

The present invention relates to a grounding switch having a fixed switch piece attached to an equipment part to be grounded and a switch piece displacable relative to the fixed switch piece by a drive. The switch pieces partially form a switch-piece overlap in their closed position. It is desirable to arrange such a grounding switch such that, while maintaining its geometrical dimensions, it can switch even large currents such as short-circuit currents without the main contacts being overloaded by the switching arc. By the present invention, the switch pieces are each equipped with at least one main contact and at least one sparking contact surrounded at least partially by the respective main contact. One of the two sparking contacts is arranged as a bush and the other as a pin. The bush includes a follow-up contact or follow-up pin which is movable in the direction of displacement of the displacable switch piece. The follow-up contact is located substantially within the interior of the bush.

4 Claims, 2 Drawing Figures

GROUNDING SWITCH

BACKGROUND AND SUMMARY OF THE PRESENT INVENTION

The present invention relates generally to a grounding switch. More particularly, the present invention relates to a grounding switch with a fixed switch piece attached to an equipment part to be grounded and with a switch piece displacable relative to the fixed switch piece by a drive with the switch pieces partially forming a switch-piece overlap in their closed position.

A grounding switch of this type is disclosed in German Auslegeschrift No. 2,155,398. This grounding switch is a manual grounding device, but is not intended for switching high powers. To avoid switching the grounding switches with high power, special bypass circuits are used or the grounding switch is replaced by a load breaker switch with sufficient breaking capacity. However, these measures make the switchgear having the grounding switches more expensive.

An object of the present invention is, therefore, to provide a grounding switch which is relatively simple in construction such that, while maintaining its geometrical dimension, it can switch even large currents such as short-circuit currents.

Numerous advantages are obtained by the present invention. For example, with a switch according to the present invention, the breaking capacity is improved, without increasing the switch dimensions. Also, when a grounding switch according to the present invention is cut out, the breaking current from the main contacts or the normal current path commutates safely from the outside into the center of the grounding switch and inwards to sparking contacts. In other words, there is a firm contact connection between the sparking contacts even through the main contacts have already separated. In the case of extreme loads, a switch according to the present invention meets the safety requirements since a circuit-breaking arc cannot burn from the center of the switch outwards and thus against a shield of the main contact or contacts. In other words, during circuit-breaking, the current or the contact separation is forced into the center of the contact system or the contact zone, once the main contacts have opened.

In comparison with known grounding switches, the switch according to the present invention switches larger currents without the switch pieces being overloaded as a result and without a significant increase in the overall dimensions of the switch. Overloading is substantially eliminated since the arc time is considerably reduced according to the invention. Moreover, the components required for such an improvement in the breaking capacity of the grounding switch are not only especially simple, reliable to operate and sturdy, but are also relatively few in number.

According to a further aspect of a grounding switch according to the present invention, the simple assembly and removal and, consequently, simple exchangability of the individual parts of the contact system is achieved. Further, the advantageous interaction of the individual parts is achieved without a special design of these parts. In particular, radial commutation contacts or a complex contacting of the sparking contacts is not required.

Further advantages to the grounding switch according to the present invention includes less expensive production costs and simplified construction. Also, the intervals between regular maintenance and inspection of the switch are not reduced. Still further, a compact and small construction is possible with a switch according to the present invention.

BRIEF DESCRIPTION OF THE DRAWINGS

A preferred embodiment of the present invention be described in greater detail with reference to the accompanying drawings, wherein like members bear like reference numerals and wherein.

DETAILED DESCRIPTION OF THE PREFERRED EMBODIMENT

Figure 1:
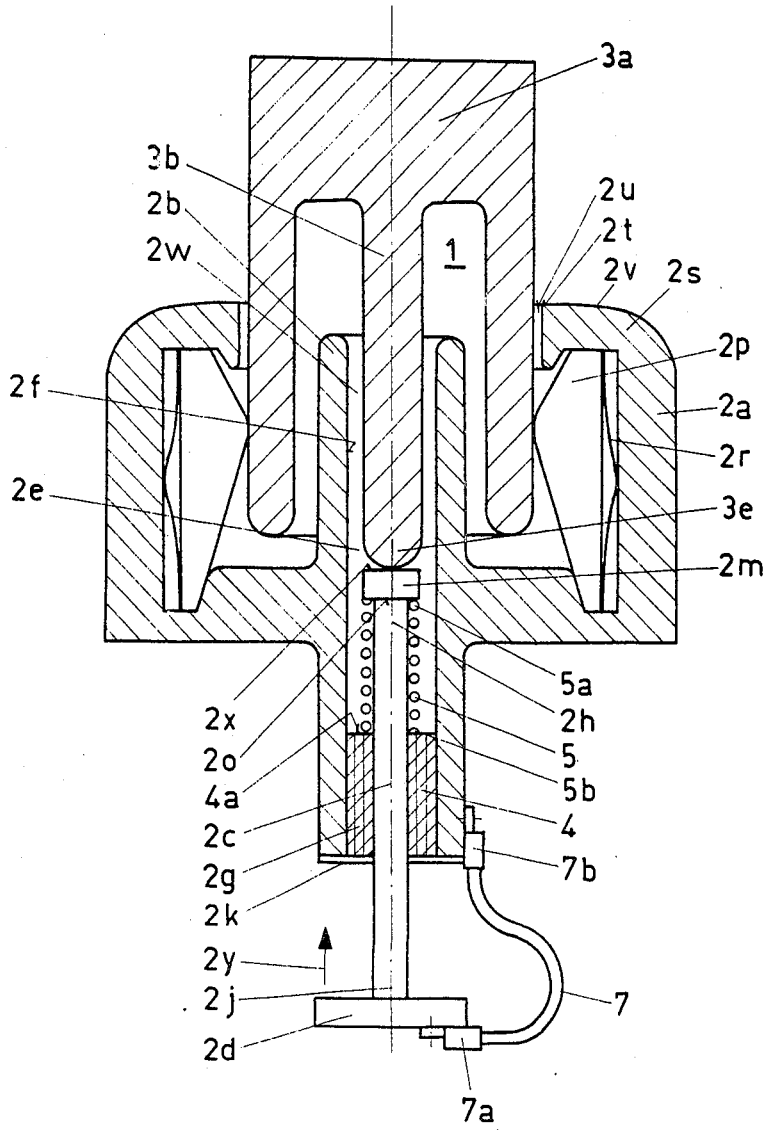
FIG. 1 is a schematic view of a switch according to the present invention.

With reference to FIG. 1 and to a closed state, a displacable tubular main contact or tube contact 3*a* engages into a fixed tulip-shaped main contact or tulip contact 2*a*. Contact is made with the tulip contact 2*a* by contact fingers 2*p* which are mounted resiliently in the tulip contact 2*a* by finger springs 2*r* that press the contact fingers 2*p* against the tube contact 3*a*. A fixed part 2*s* of the tulip contact 2*a* is bent towards the tube contact 3*a* and has a gap or air gap 2*u* at an annular free end 2*t* between the annular free end 2*t* and the tube contact 3*a*. In this way, the contacts 2*a* and 3*a* engage securely into one another during closing. The fixed part 2*s* bent towards the tube contact 3*a* not only serves as a one-sided mounting for the contact fingers 2*p*, but also, when interacting with the other contacts during circuit-breaking, prevents an arc from burning onto the outer side 2*v* of the bent part 2*s*. This arrangement also ensures that a spring of contacts sparking arising during circuit-breaking takes place at the contacts provided according to the invention in the center of the contact system.

During closing of the switch, a sparking pin 3*b* rigidly connected to the tube contact 3*a* is brought into the ON position illustrated in FIG. 1. In the ON position, the sparking pin 3*b* is arranged at a distance 2*w* from a sparking bush 2*b* in a cavity 2*e* of the sparking bush 2*b*. The distance 2*w* ensures that the contacts 2*b* and 3*b* engage within one another during movement of the tube contact 3*a*.

Figure 2:
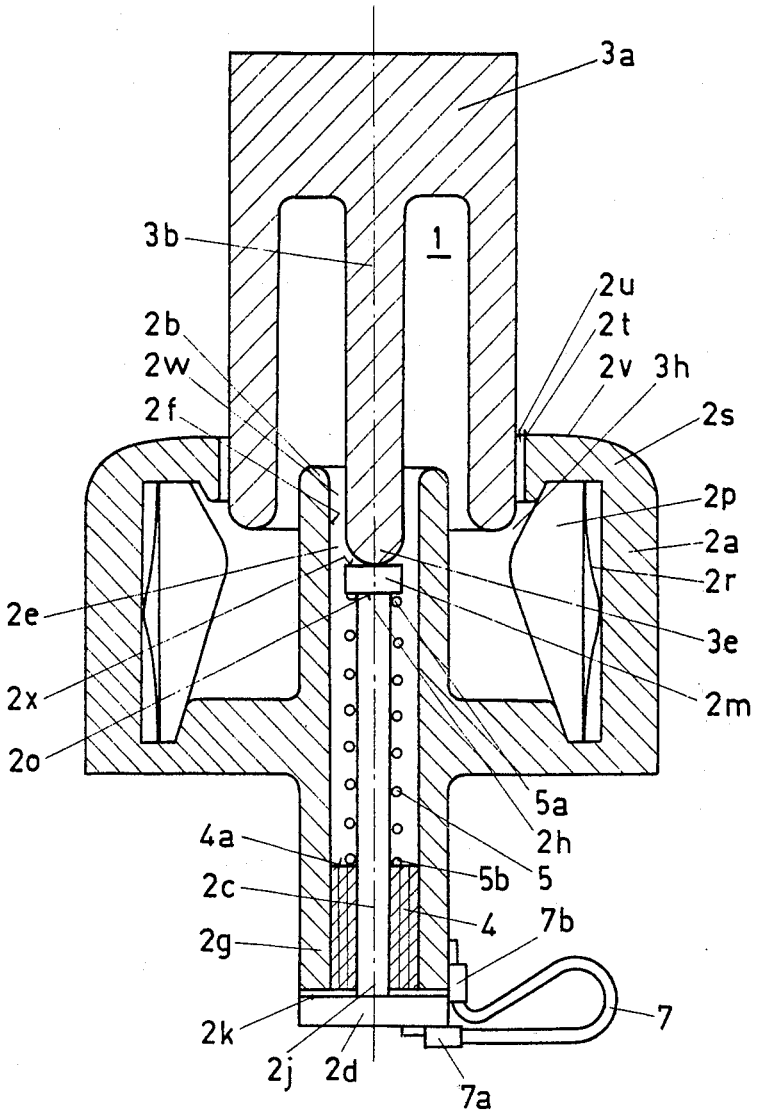
FIG. 2 is a schematic view of the switch of FIG. 1 at the moment when, during circuit-breaking, a sparking pin is just about to separate from the follow-up pin.

With reference to a temporary position illustrated in FIG. 2, the sparking pin 3*b* strikes against a free end face 2*x* of a contact head 2*m* of a follow-up pin 2*c*, as a result of which the follow-up pin 2*c* assumes the end position evident from FIG. 1. At the same time, a compression spring 5 guided on the follow-up pin 2*c* and clamped between the contact head 2*m* at one end and a slide bearing 4 at the other end is compressed further or prestressed additionally.

The grounding switch 1 is arranged with regard to construction and dielectrics such that, when the switch is closed, the closing arc first ignites between the sparking pin 3*b* and the sparking bush 2*b*. Accordingly, the arc first burns from the pin 2*c* to the bush 2*b* or vice versa, so that the contact fingers 2*p* of the tulip contact 2*a* are protected. In the course of the further closing operation, a short-circuit current to be switch is commutated to the main contacts 2*a* and 3*a* and thus to the contact fingers 2*p*. In other words, the tube contact 3*a*, interacting with the tulip contact 2*a*, conduit the full short-circuit current by the undamaged contact fingers 2p.

Again with reference to FIG. 1 and to the closed position, the compression spring 5 is prestressed such that during a subsequent circuit-breaking operation the follow-up pin 2c is pressed by the free end face 2x of the contact head 2m with sufficient contact pressure against the free end 3e of the sparking pin 3b to urge the sparking pin 3b to the OFF position (not shown). During this time, the movement or displacement of the follow-up pin 2c follows the circuit-breaking displacement of the sparking pin 3b and is limited by a flange 2d. In other words, during the circuit-breaking displacement of the sparking pin 3b, the flange 2d runs up against a free end face 2k of the sparking bush 2b on the bearing side and, as a result, the follow-up pin 2c stops. Thereafter the two contacts 2c, 3b separate from one another. Accordingly, in the OFF position of the contacts (not illustrated in the drawing figures), the free end face 2x of the contact head 2m of the follow-up pin 2c is no longer engaged with the sparking pin 3b in the cavity 2e of the sparking bush 2b.

The compression spring or cylindrical helical spring 5 is supported at one end 5a on a side 2o of the contact head 2m facing away from the sparking pin free end 3e and at the other end 5b on an end face 4a on the contact head side of the slide bearing 4. The spring is sufficiently compressed to subject the follow-up pin 2c to strong pressure in a direction opposite to the closing dispacement of the sparking pin 3b. Accordingly, during renewed closing of the switch, when the sparking pin 3b abuts the follow-up pin 2c there is sufficient contact between the two contact 2c and 3b such that no arc-back occurs between the main contacts 2a, 3a during circuit-breaking. The guidance of the helical spring 5 on the follow-up pin 2c ensures that the distance 2w which exists between the bush inside wall 2f and the sparking pin 3b is also maintained between the helical spring 5 and the inside wall 2f.

The contact head 2m located on an end 2h of the following-up pin 2c facing the free end 3e of the sparking pin 3b may, if desired, be arranged so as to be easily exchangeable. Located at an end 2g of the sparking bush 2b facing away from the free end 3e is the slide bearing 4 which terminates with the sparking bush 2b at the end 2g or forms the bottom of the bush 2b with the follow-up pin 2c passing through the center of the bottom. The slide bearing 4 is preferably a maintenance-free slide bearing comprised of polytetrafluoroethylene and/or copolymers of tetrafluoroethylene and hexafluoropropylene.

The flange 2d is preferably made of metal and is located at an end 2j of the follow-up pin 2c facing away from the free end 3e of the sparking pin 3b. The flange 2d is connected to the sparking bush 2b by a flexible conductor 7 which is connected at one end 7a to the metal plate 2d and at the other end 7b to the sparking bush 2b.

With reference to FIG. 2 and for reasons of simplicity as in FIG. 1, the current feed lines and current discharge lines and the drive parts of the contacts which can be arranged in a manner previously known are not illustrated since such parts are not essential for an understanding of the present invention.

In the contact system at the moment of contact separation (as illustrated in FIG. 2), the gaps or air gaps 2u and 3h still exist between the main contacts 2a and 3a and the contact fingers 2p. The contact fingers 2p are comprised preferably of copper and are pressed by the finger springs 2r substantially transverse to the axial direction of the contact system and towards the common axis of the contact pieces. The compression spring or cylindrical helical spring 5 is in a relatively relaxed position. The spring 5 still has sufficient prestress to ensure sufficient contact pressure during switching. As a result of a movement (the direction and path of which is represented by the arrow 2y at the bottom of FIG. 1), the follow-up pin 2c reaches the limiting position determined by the flange or the metal plate 2d during circuit-breaking. It is highly desirable, in the closed state and at the start of cutting-out of the grounding switch, that the follow-up contact or follow-up pin 2c maintains contact with the sparking pin 3b under the urging of the compression spring 5. Also, during further cutting-out, the follow-up pin 2c follows the pin 3b to a limited extent until the contacts 2c and 3b separate which extent is predetermined as a result of the limitation of the movement of the follow-up contact 2c. The contacts 2c and 3b separate after the contacts 2a and 3a have already separated as a result of the cutting-out movement.

In a modification of the embodiment illustrated in FIGS. 1 and 2, a multi-contact arrangement, called an MC contact, can be provided as a bearing, instead of the slide bearing 4. This arrangement involves resilient strip-shaped metal contacts of equal length which contacts are arranged essentially parallel to one another and include at least portions canted towards the shell surface of the follow-up pin 2c. Each of the contacts is connected at their ends by a metal strip. Such an MC arrangement is arranged between the bush inside wall 2f and the follow-up pin 2c similar to the arrangement of the teflon bearing 4. The strip-shaped metal contact extend in the axial direction of the pin 2c, in the same way as crossbars of a flexible conductor coiled around the follow-up pin 2c. As a result of the resilient canting of the contacts, i.e., the orientation of the strip planes through an acute angle towards the shell surface of the follow-up pin 2c, the contacts generate the required contact pressure between the bush inside wall 2f and the shell surface of the follow-up pin 2c. Advantages of such a bearing are, among other things, the elimination of the electrical connection 7 and the compactness of such an arrangement. Also a further advantage lies in the high current carrying capacity of such a bearing and therefore of the parallel current path formed by the contacts 2c and 3b, to the nominal current path formed by the main contacts 2a and 3a. Suitable slide bearings, especially made of plastic (teflon), may also be provided if desired for guiding the following-up pin 2c in order to relieve mechanical stresses on both sides of such an MC arrangement.

With reference to FIGS. 1 and 2 of the present invention, the grounding switch 1 according to the invention is distinguished by the retention of optimally small dimensions.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes that fall within the spirit and scope of the present invention as defined in the claims be embraced thereby.

What is claimed is:

1. A grounding switch, comprising a fixed switch piece attached to an equipment part to be grounded, a switch piece displacable with respect to the fixed switch piece by a drive, the switch pieces partially forming a switch-piece overlap in their closed position, the switch pieces each have at least one main contact and at least one sparking contact surrounded at least partially by the respective main contact, the sparking contacts are spaced from the main contacts, one of the two sparking contacts is a bush and the other is a pin adapted to be received within the bush, the sparking contact which is a sparking bush includes a follow-up contact which is movable to a limited extent in a direction parallel to a displacement direction of the displaceable switch piece, and the follow-up contact being located within the interior of the sparking bush, a free end of said sparking bush extending beyond a free end of the follow-up contact in all positions of said follow-up contact.

2. The grounding switch according to claim 1, wherein the follow-up contact is a pin, the follow-up pin being guided by a slide bearing attached to the sparking bush, a compression spring guided on the follow-up pin is arranged between an end of the follow-up pin facing a free end of the sparking pin and the slide bearing, the follow-up pin includes a flange on an end facing away from the free end of the sparking pin, said flange being adapted to abut against a free end face of the sparking bush to limit the displacement movement of the follow-up pin, and the sparking bush having an electrical connection to the follow-up pin near the free end face.

3. The grounding switch according to claim 2, wherein the electrical connection of the follow-up pin to the sparking bush comprises a flexible conductor having one end electrically conductively connected to the flange which is of metal and the other end connected to the sparking bush, the conductor having a length permitting the limited displacement movement of the follow-up pin, the slide bearing being polytetrafluoroethylene and/or copolymers of tetrafluoroethylene and hexafluropropylene, the slide bearing forming the bottom of said bush at the end of the sparking bush facing away from the free end of the sparking pin, and the follow-up pin passing through the center of the bottom.

4. The grounding switch according to claim 2 or 3, further comprising a multi-contact arrangement adjacent the slide bearing.

* * * * *